US006547646B2

(12) United States Patent
Eastman, Jr. et al.

(10) Patent No.: US 6,547,646 B2
(45) Date of Patent: Apr. 15, 2003

(54) METHOD FOR SUPPLYING SLURRY TO A SEMICONDUCTOR PROCESSING MACHINE

(75) Inventors: Arnold B. Eastman, Jr., Vancouver, WA (US); Michael W. Shepherd, Oregon City, OR (US); Jack R. Wells, Battle Ground, WA (US)

(73) Assignee: Seh America, Inc., Vancouver, WA (US)

( * ) Notice: Subject to any disclaimer, the term of this patent is extended or adjusted under 35 U.S.C. 154(b) by 0 days.

(21) Appl. No.: 09/804,680

(22) Filed: Mar. 12, 2001

(65) Prior Publication Data

US 2002/0001956 A1 Jan. 3, 2002

Related U.S. Application Data

(62) Division of application No. 09/201,273, filed on Nov. 30, 1998, now Pat. No. 6,200,202.

(30) Foreign Application Priority Data

Mar. 9, 2000 (JP) ..... 2000-065594

(51) Int. Cl.[7] ..... B24B 1/00; B24C 2/00
(52) U.S. Cl. ..... 451/41; 451/60; 451/99
(58) Field of Search ..... 451/60, 99, 100, 451/41

(56) References Cited

U.S. PATENT DOCUMENTS 4,272,924 A 6/1981 Masuko et al.
4,347,134 A 8/1982 Svehaug
4,347,223 A 8/1982 Kitaoka et al.
4,974,370 A 12/1990 Gosis
5,036,625 A 8/1991 Gosis
5,618,177 A 4/1997 Abbott
5,775,980 A 7/1998 Sasaki et al.
5,795,601 A 8/1998 Yamada et al.
5,799,643 A 9/1998 Miyata et al.
5,800,246 A 9/1998 Tomioka
5,839,951 A 11/1998 Tomioka
5,957,759 A 9/1999 Cardenas et al.
6,006,738 A * 12/1999 Itoh et al. ..... 125/16.01
6,293,849 B1 * 9/2001 Kawashima ..... 451/287
6,425,802 B1 * 7/2002 Custer et al. ..... 451/5

* cited by examiner

*Primary Examiner*—M. Rachuba
(74) *Attorney, Agent, or Firm*—Alston & Bird LLP

(57) ABSTRACT

A method for supplying a slurry of a liquid containing suspended particles to a semiconductor processing machine, where the slurry is used in processing semiconductor wafers, is disclosed. The method includes providing a supply of slurry and delivering slurry to the semiconductor processing machine. The supply typically provides slurry from a location remote from the semiconductor processing machine to a location proximate the semiconductor processing machine, where the slurry at the location proximate the semiconductor processing machine is unpressurized. A delivery subsystem typically agitates slurry in the basin by flowing the slurry through the basin, thereby inhibiting the settling of suspended particles in the slurry.

22 Claims, 3 Drawing Sheets

METHOD FOR SUPPLYING SLURRY TO A SEMICONDUCTOR PROCESSING MACHINE

CROSS-REFERENCE TO RELATED APPLICATION

This application is a divisional continuation of U.S. patent application Ser. No. 09/201,273, filed Nov. 30, 1998 now U.S. Pat. No. 6,200,202 of Arnold B. Eastman, Jr., Michael W. Shepherd and Jack R. Wells for a SYSTEM AND METHOD FOR SUPPLYING SLURRY TO A SEMICONDUCTOR PROCESSING MACHINE, the disclosure of which is hereby incorporated by reference.

TECHNICAL FIELD

The present invention relates generally to supplying a slurry of a liquid containing suspended particles to a semiconductor processing machine, where the slurry is used in processing semiconductor wafers.

BACKGROUND OF THE INVENTION

Liquid mixtures with suspended particles, such as slurries, facilitate many industrial processes. One common industrial process in which slurries are utilized is the precision lapping and polishing of thin semiconductor wafers by semiconductor processing machines, such as a lapping machine. Slurries used in lapping and polishing semiconductor wafers typically are thin mixtures of an abrasive, such as aluminum oxide, and water.

In the lapping process, a lapping machine typically supports the wafer in a carrier, sandwiched between two parallel lapping plates. The lapping machine distributes the abrasive slurry to the semiconductor wafer at various locations along the lapping plates, such that the slurry forms a thin, even layer between the lapping plates and the semiconductor wafer. Rotating action of the carrier between the lapping plates causes the semiconductor wafer to grind against the abrasive slurry, thereby smoothing the surface of the semiconductor wafer.

Slurry may be supplied to a lapping machine by a variety of slurry supply systems. For small-scale operations involving one lapping machine or a group of lapping machines located in a small area, a portable container of slurry may be placed near the lapping machines such that a pump on each lapping machine may draw slurry out of the portable container and into each lapping machine. Because particles tend to settle out of a slurry when the slurry stagnates, a mechanical agitator is typically used in such a portable container to keep the particles suspended in the slurry. However, mechanical agitators are expensive and contain moving parts that require service after repeated use.

For large-scale production of silicon wafers, it is common for several lapping machines to receive a supply of slurry from a common reservoir. The lapping machines are often distributed throughout a factory complex, and may be located remote from the reservoir, such as on a separate level of the factory vertically distant from the reservoir. To supply distributed lapping machines with slurry in such a large-scale setting requires a supply conduit extending from the reservoir to each machine. A supply conduit pump pumps the slurry from the reservoir to each lapping machine through the supply conduit. The supply conduit typically runs through a factory floor, and supplies slurry to lapping machines located on the factory floor above the supply conduit.

In current large-scale slurry supply systems, the supply conduit pump pressurizes the supply conduit. Delivery lines in the form of flexible tubing attach to headers located on the pressurized supply conduit at locations proximate each lapping machine. The headers on the supply conduit allow some pressure from the supply line to be transferred through the header such that slurry flows out the header and into the flexible tubing. Peristaltic pumps on the top of each lapping machine act in conjunction with the pressure from the supply conduit to draw slurry up and into each lapping machine.

Several problems exist with such pressurized supply conduits. First, where the reservoir is vertically distant from the lapping machines, great pumping force is required to pressurize the supply conduit. Under such strain, the supply conduit pump wears out at an accelerated pace. Repeated replacement of the supply conduit pump is costly, as is outfitting the supply conduit with a larger pump capable of generating adequate pressure.

In addition, inadequate pressure in the supply conduit, such as occurs when the supply conduit pump is wearing out or straining to pressurize the supply conduit, lowers the efficiency of the peristaltic pumps drawing slurry from the supply conduit to each of the lapping machines. The peristaltic pumps experience low efficiency because the supply conduit pump conveys slurry at a slow rate into the flexible tubing, causing the peristaltic pumps to pump less slurry with each stroke on the flexible tubing than would be pumped if slurry was conveyed at a faster rate. To achieve a desired flow into the lapping machine, the low-efficiency peristaltic pumps must be run at higher stroke rates, resulting in a shorter pump life for the peristaltic pumps. Higher stroke rates, in turn, cause the flexible tubing to wear and crack prematurely.

SUMMARY OF THE INVENTION

A slurry supply system is provided for supplying a slurry of a liquid containing suspended particles to a semiconductor processing machine, where the slurry is used in processing semiconductor wafers. The slurry supply system includes a supply of slurry and a delivery subsystem operatively associated with the supply of slurry. The delivery subsystem typically is configured to deliver slurry to the semiconductor processing machine. The delivery subsystem typically but not necessarily includes a basin and a first pump associated with the basin, where the first pump is configured to convey slurry from the supply to the basin. The delivery subsystem also typically but not necessarily includes a second pump configured to convey slurry from the basin to the semiconductor processing machine. The supply also typically but not necessarily is configured to provide slurry from a location remote from the semiconductor processing machine to a location proximate the semiconductor processing machine. The delivery subsystem also is typically but not necessarily configured to agitate slurry in the basin by flowing the slurry through the basin, thereby inhibiting the settling of suspended particles in the slurry.

DETAILED DESCRIPTION AND BEST MODE FOR CARRYING OUT THE INVENTION

Figure 1:
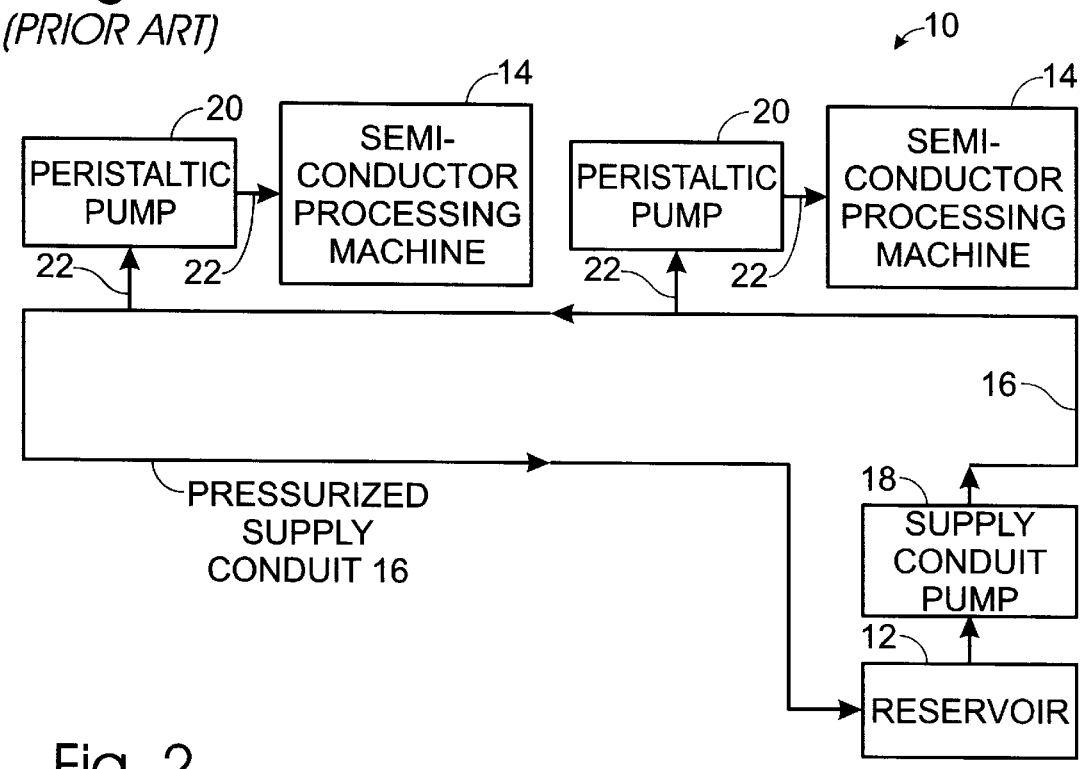
Fig. 1 (PRIOR ART)
FIG. 1 is a schematic view of a prior art slurry supply system.

FIG. 1 shows a prior art system 10 for delivering a slurry of a liquid containing suspended particles from a reservoir 12 to semiconductor processing machines 14, via a pressurized supply conduit 16. Prior art system 10 utilizes supply conduit pump 18 to pump slurry from the reservoir through the pressurized supply conduit. Peristaltic pumps 20 draw the slurry from pressurized supply conduit 16 through flexible lines 22 and into semiconductor processing machines 14. As explained, prior art system 10 is plagued by low efficiency and accelerated wear in supply conduit pump 18 and peristaltic pumps 20, and premature wear and cracking in flexible lines 22.

Figure 2:
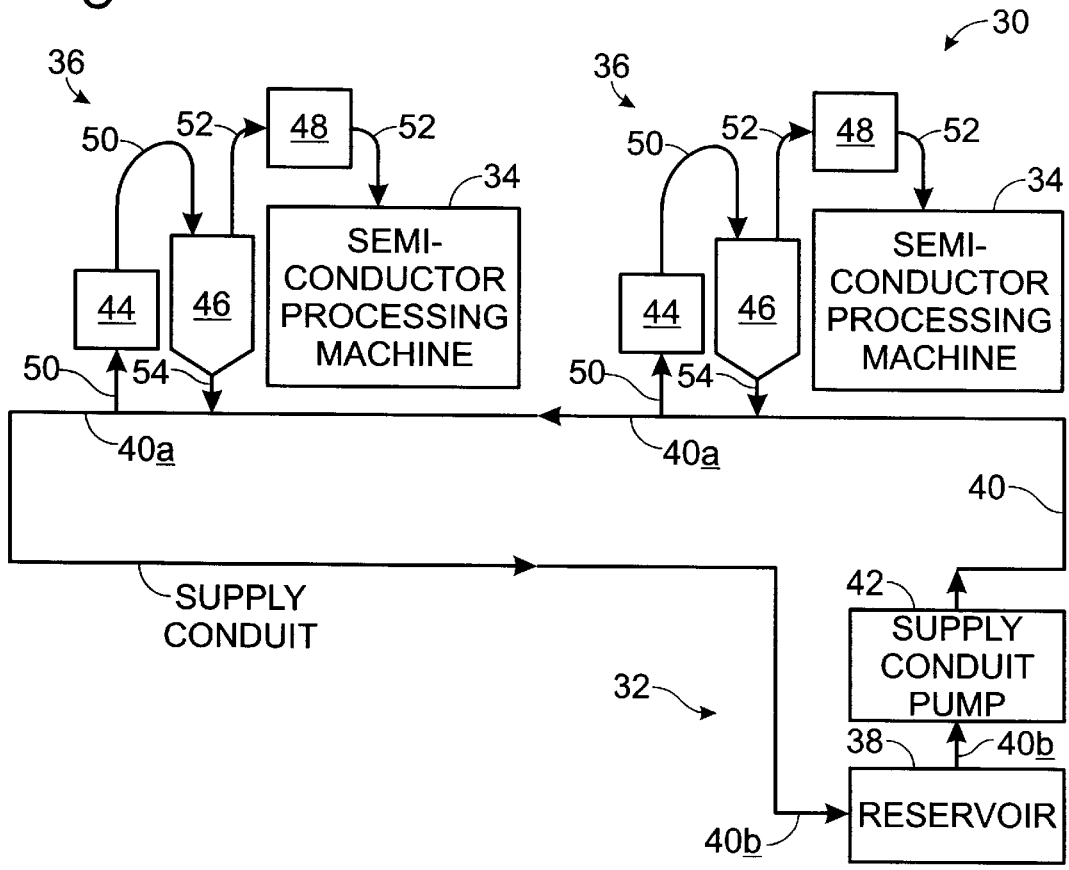
FIG. 2 is a schematic view of a slurry supply system according to the present invention.

FIG. 2 shows a slurry supply system 30 according to the present invention for distributing a slurry of a liquid with suspended particles. Typically, the slurry is a liquid mixture containing an abrasive, such as aluminum oxide, a rust inhibitor, a suspension agent, a lubricant, such as soap, and water. The present invention also may be practiced with slurries of various other compositions. The term slurry as used herein refers to any liquid with suspended particles, and is not limited to water-based mixtures.

Slurry supply system 30 includes a supply 32, semiconductor processing machines 34, and delivery subsystems 36 configured to convey a portion of slurry from the supply to the semiconductor processing machines. Supply 32 includes a reservoir 38 configured to hold slurry, a supply conduit 40 extending from reservoir 38, and a supply conduit pump 42 configured to pump slurry from the reservoir through the supply conduit. Reservoir 38 typically is located remote from semiconductor processing machines 34, such as on a lower level of a factory with semiconductor processing machines located on an upper level. Supply conduit 40 typically extends up from pump 42, and then extends horizontally within the floor of the upper level to locations 40*a* proximate the semiconductor processing machines. Alternatively, supply conduit 40 and basin 46 may be elevated above the semiconductor processing machine such that gravity or siphoning action draws slurry through the inflow conduit and the outflow conduits.

Supply conduit pump 42 is configured to pump slurry from the reservoir through supply conduit 40 such that the slurry in supply conduit 40 at locations 40*a* proximate the semiconductor processing machines 34 is at a low pressure or is effectively meaning that the slurry is at or near atmosphere pressure. The supply conduit is attached at each of two ends 40*b* to the reservoir, and is configured to circulate slurry out of the reservoir to locations 40*a*, and then back into the reservoir.

Delivery subsystem 36 includes a first pump 44, a basin 46, and a second pump 48. The first pump 44 is configured to convey slurry from the slurry conduit 40 to the basin 46. The second pump 48 is configured to convey slurry from the basin 46 to the semiconductor processing machine 34. Use of first pump 44, basin 46, and second pump 48 facilitates the delivery of slurry from the locations 40*a* in the supply to the semiconductor processing machines.

Figure 3:
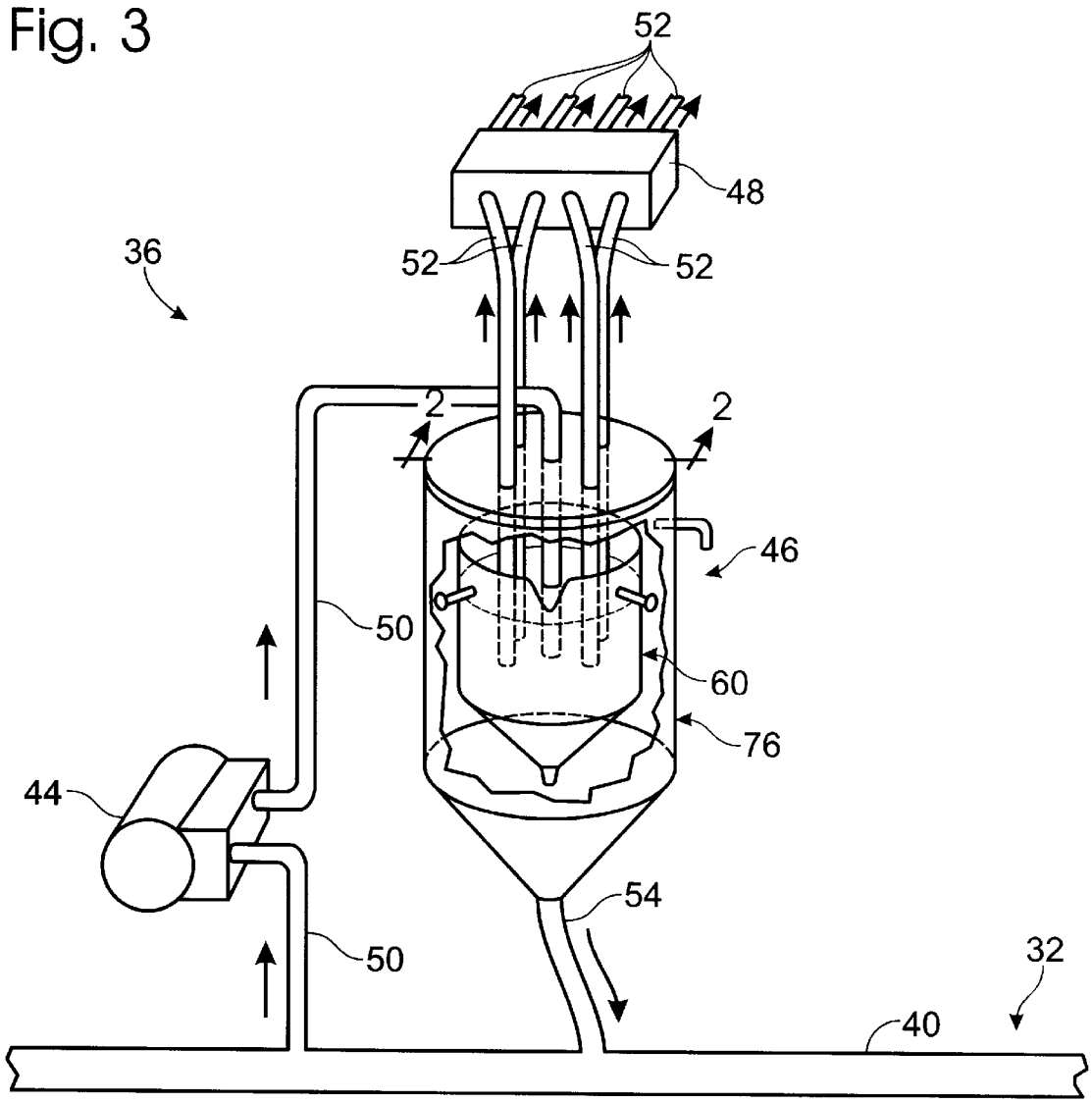
FIG. 3 is a perspective view of a delivery subsystem of a slurry supply system according to the present invention.

Delivery subsystem 36 further includes an inflow conduit 50 associated with the first pump 44. First pump 44 also may be referred to as inflow conduit pump. The inflow conduit is configured to direct slurry from supply conduit 40 to basin 46. Delivery subsystem 36 also includes an outflow conduit 52 associated with the second pump 48, also referred to as outflow conduit pump 48. The outflow conduit is configured to direct slurry from basin 46 to semiconductor processing machine 34. As shown in FIG. 3, inflow conduit pump 44 typically but not necessarily is a rotary pump, and outflow conduit pump 48 typically but not necessarily is a peristaltic pump. Any other type of pump configured to convey liquid also may be used as inflow conduit pump 44 or outflow conduit pump 48.

Delivery subsystem 36 also includes a return conduit 54 configured to return a portion of the slurry from basin 46 to supply conduit 40. The portion of slurry returned to the supply typically is flowed through the basin to agitate slurry in the basin and inhibit the settling of suspended particles in the slurry. Alternatively, the portion of slurry flowed through the basin may be removed from the basin to a waste conduit or to another conduit not connected to the supply.

Figure 4:
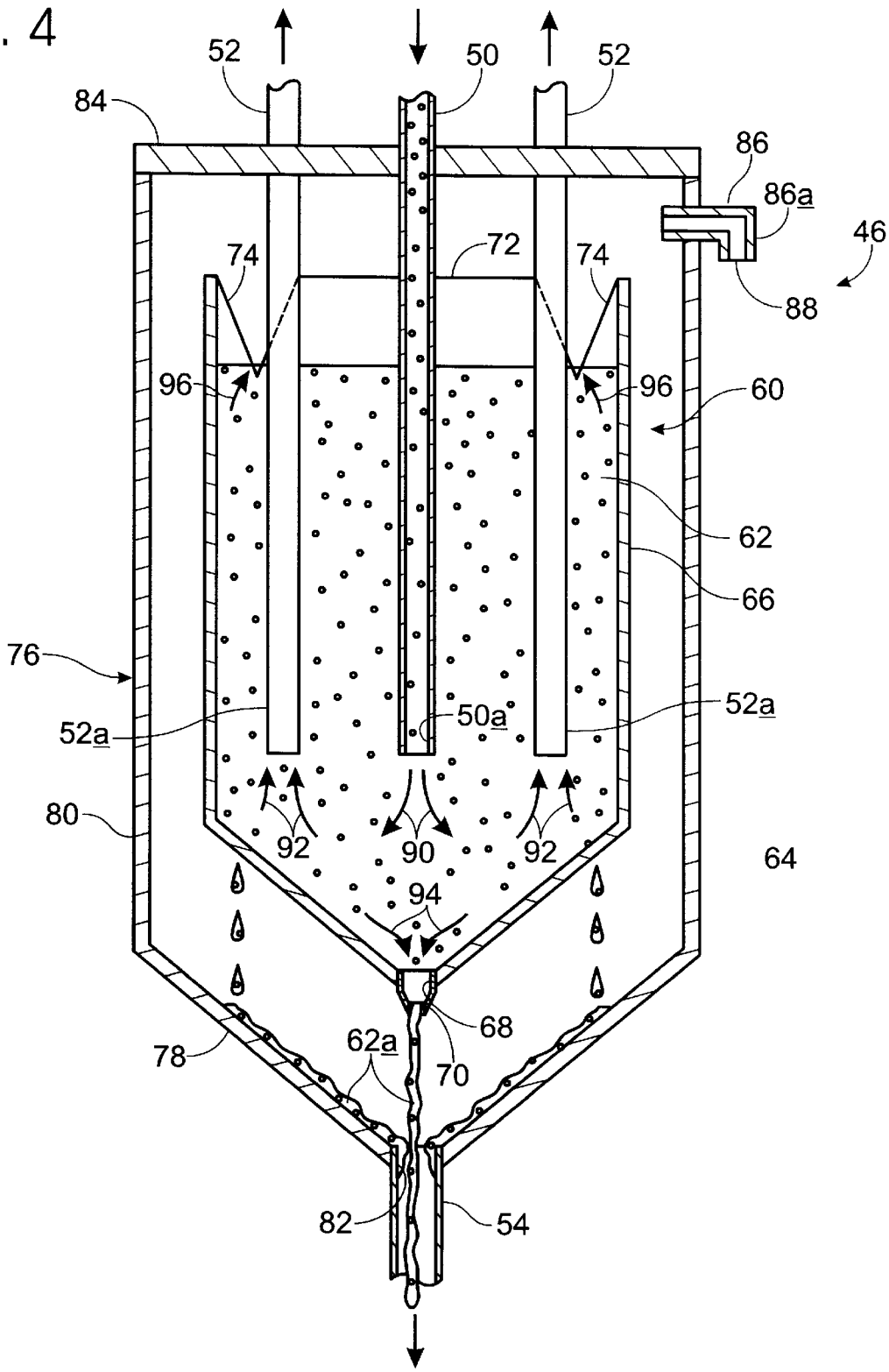
FIG. 4 is a cross-sectional view of a basin of the slurry supply system, taken along line 2—2 in FIG. 3.

As shown in FIG. 4, basin 46 includes a container 60 having a generally funnel-shaped bottom portion 64, and a wall 66 extending around and enclosing the generally funnel-shaped bottom portion. Alternatively, container 60 may include a bottom portion that is flat or curved. Funnel-shaped bottom portion 64 is configured to guide slurry 62 to a drain 68 situated at a confluence of the generally funnel-shaped bottom portion. Drain 68 also may be located elsewhere. Drain 68 typically includes a nozzle 70 for regulating the flow of slurry through the drain.

Wall 66 of container 60 typically terminates in a lip 72, the lip being configured to allow slurry to overflow from the container. Container 60 also may include overflow gates 74 configured to channel slurry as it overflows from container 60. Overflow gates 74 may be formed in lip 72, and may be V-shaped. Alternatively, overflow gates 74 may be openings or conduits situated in a top portion of the basin. Overflow gates 74 may channel slurry to spill over and down an outside surface of container 60, or alternatively, may direct slurry away from container 60.

Basin 46 also typically includes an enclosure 76 having a catch portion 78 and a wall 80 extending around the catch portion. Catch portion 78 typically is generally funnel-shaped. Catch portion 78 also may be flat, concave, or convex. Catch portion 78 also typically includes a return opening or drain 82 to direct slurry 62*a* draining and overflowing from the container into return conduit 54. Return opening 82 is typically situated at a confluence of the catch portion. Alternatively, the return opening may be located elsewhere. As shown in FIG. 3, return conduit 54 is configured to direct the slurry back to supply conduit 40. Alternatively, return conduit 54 may direct the slurry to a waste line, or to another line not associated with the supply.

Returning to FIG. 4, enclosure 76 also typically includes a top 84 attached to an upper portion of wall 80. In the depicted embodiment, inflow conduit 50 and outflow conduits 52 are secured to top 84 and extend therefrom into container 60. Alternatively, the inflow conduit and outflow conduits may enter from a side or bottom portion of the basin. When basin 46 is in operation, openings 50*a* and 52*a* are submerged within slurry 62 in basin 46. The submerged orientation of opening 50*a* inhibits foaming of the slurry by prevention of the invention of air into the slurry basin 46 as slurry is added to the basin through inflow conduit 50. The submerged orientation of each of openings 52*a* inhibits air from entering outflow conduits 52 as slurry is being drawn from container 60.

Enclosure 76 also typically includes an air duct 86 extending through the enclosure, configured to allow air to pass into and out of basin 46 to facilitate changing volumes of slurry in basin 46. The air duct typically but not necessarily includes a downward-facing opening 86*a* and a screen 88.

The downward-facing opening and the screen inhibit pollutants from passing through air duct 86 into enclosure 76.

Delivery subsystem 36 typically is configured to agitate the slurry contained in basin 46 by adding or flowing slurry into the basin through inflow conduit 50 along flow lines 90, and draining slurry from the basin along flow lines 94, thereby inhibiting the settling of the suspended particles in slurry 62. In addition, delivery system 36 typically is configured to agitate the slurry in the basin by conveying the slurry into outflow conduits 52 and conveying the slurry to the semiconductor processing machine along flow lines 92, and by overflowing the slurry from the container along flow lines 96. Alternatively, the delivery system may be configured to agitate the slurry only by adding and draining slurry. Flow lines 90–96 are for illustrative purposes and only generally indicate the actual flow of slurry in container 60. Other flows from adding, draining, conveying, and overflowing may be realized according to the present invention to inhibit the settling of suspended particles in the slurry. Other mechanisms also may be used to agitate the slurry.

In the operation of delivery subsystem 36, inflow conduit pump 44 conveys or pumps slurry from the supply along inflow conduit 50 into basin 46, such that the slurry flows through opening 50*a* along flow lines 90. Typically, a portion of the slurry drains from the basin through drain 68 at a rate slower than the rate of flow of slurry into the basin through inflow conduit 50. Because of the difference in the rates of flow into and out of the basin, basin 46 fills with slurry. Once the basin fills with slurry outflow conduit pump 48 typically draws slurry into outflow conduit 52 along flow lines 92 and conveys the slurry to the semiconductor processing machine.

The rate of flow of slurry into the basin typically is greater than the rate of flow through the drain and the outflow conduit combined, causing the basin to overflow. When the level of slurry in container 60 reaches overflow gate 74 or lip 72, the slurry typically is overflowed along flow lines 96 from the container 60. Alternatively, once a volume of slurry is achieved in the basin, the rates of flow into and out of the basin may be adjusted to maintain the volume of slurry in the basin without overflow of the slurry. In addition, rates of flow through the inflow conduit, the outflow conduit, the drain, and the overflow gate may be adjusted in tandem to maintain the volume of slurry in the basin.

Catch portion 78 of the enclosure is configured to collect a portion of the slurry overflowing and/or draining from the basin and guide it to return conduit 54 for return to the supply. Because the slurry draining and overflowing from the basin has not been used by semiconductor processing machine 34, and typically has not been otherwise contaminated, it may be recirculated to the supply for use by the same or another semiconductor processing machine.

INDUSTRIAL APPLICABILITY

This invention is applicable to the semiconductor processing industry, and particularly to machines that use a slurry to process semiconductors. This invention is particularly applicable to lapping and polishing machines, and is also applicable to cutting machines, wire saws and other machines.

While the invention has been disclosed in its preferred form, the specific embodiments thereof as disclosed and illustrated herein are not to be considered in a limiting sense as numerous variations are possible. Applicant regards the subject matter of the invention to include all novel and non-obvious combinations and subcombinations of the various elements, features, functions and/or properties disclosed herein. No single feature, function, element or property of the disclosed embodiments is essential. The following claims define certain combinations and subcombinations which are regarded as novel and non-obvious. Other combinations and subcombinations of features, functions, elements and/or properties may be claimed through amendment of the present claims or presentation of new claims in this or a related application. Such claims are also regarded as included within the subject matter of applicant's invention irrespective of whether they are broader, narrower, or equal in scope to the original claims.

We claim:

1. A method for supplying a slurry of a liquid containing suspended particles to a semiconductor processing machine, where the slurry is used in processing semiconductor wafers, and the method comprising:

providing a supply of slurry;

conveying slurry from the supply to a basin having a container via a first pump;

overflowing a portion of the slurry from the container; and conveying slurry from the basin to the semiconductor processing machine via a second pump.

2. The method for supplying a slurry of a liquid containing suspended particles to a semiconductor processing machine, where the slurry is used in processing semiconductor wafers, the method comprising:

providing a supply of slurry, wherein the supply includes a reservoir holding slurry, a supply conduit connected to the reservoir, and a supply conduit pump associated with the supply conduit;

conveying slurry from the supply to a delivery subsystem including a basin via a first pump, wherein conveying slurry from the supply to the basin comprises pumping the slurry with the supply conduit pump through the supply conduit from the reservoir remote from the semiconductor processing machine to the basin proximate the semiconductor processing machine, and wherein the slurry proximate the semiconductor processing machine is unpressurized; and conveying slurry via the delivery subsystem from the basin to the semiconductor processing machine via a second pump.

3. The method of claim 2, wherein the supply conduit is connected at each of two ends to the reservoir, and the supply conduit pump circulates slurry from the reservoir through the supply conduit, and back to the reservoir.

4. The method of claim 1, wherein the delivery subsystem agitates the slurry in the basin to inhibit the settling of suspended particles in the slurry.

5. The method of claim 4, wherein the delivery subsystem agitates the slurry by allowing a portion of the slurry to flow through the basin.

6. The method of claim 5, wherein the basin includes a drain.

7. The method of claim 1, wherein the delivery subsystem further includes an inflow conduit which directs slurry from the supply to the basin and includes an outflow conduit which directs slurry from the basin to the semiconductor processing machine, wherein the first pump is an inflow conduit pump which pumps slurry from the supply to the basin through the inflow conduit, and the second pump is an outflow conduit pump which pumps slurry from the basin to the semiconductor processing machine through the outflow conduit.

8. The method for supplying a slurry of a liquid containing suspended particles to a semiconductor processing machine, where the slurry is used in processing semiconductor wafers, the method comprising:

providing a supply of slurry;

conveying slurry from the supply to a delivery subsystem including a basin via a first pump; and conveying slurry from the basin to the semiconductor processing machine via a second pump, wherein the delivery subsystem further includes an inflow conduit which directs slurry from the supply to the basin and includes an outflow conduit which directs slurry from the basin to the semiconductor processing machine, wherein the first pump is an inflow conduit pump which pumps slurry from the supply to the basin through the inflow conduit, and the second pump is an outflow conduit pump which pumps slurry from the basin to the semiconductor processing machine through the outflow conduit, and wherein the inflow conduit includes an opening from which slurry may flow into the basin, the opening of the inflow conduit being situated in the basin such that during operation of the delivery subsystem the opening is submerged in the slurry in the basin to inhibit foaming of the slurry in the basin.

9. The method for supplying a slurry of a liquid containing suspended particles to a semiconductor processing machine, where the slurry is used in processing semiconductor wafers, the method comprising:

providing a supply of slurry;

conveying slurry from the supply to a delivery subsystem including a basin via a first pump; and conveying slurry from the basin to the semiconductor processing machine via a second pump, wherein the delivery subsystem further includes an inflow conduit which directs slurry from the supply to the basin and includes an outflow conduit which directs slurry from the basin to the semiconductor processing machine, wherein the first pump is an inflow conduit pump which pumps slurry from the supply to the basin through the inflow conduit, and the second pump is an outflow conduit pump which pumps slurry from the basin to the semiconductor processing machine through the outflow conduit, and wherein the outflow conduit includes an opening into which slurry from the basin may enter, the opening of the outflow conduit being situated in the basin such that during operation of the delivery subsystem the opening is submerged in the slurry in the basin to inhibit air from entering the outflow conduit.

10. The method for supplying a slurry of a liquid containing suspended particles to a semiconductor processing machine, where the slurry is used in processing semiconductor wafers, the method comprising:

providing a supply of slurry;

conveying slurry from the supply to a delivery subsystem including a basin via a first pump, wherein the basin includes a drain which allows slurry to flow from the basin, and wherein the slurry in the basin is agitated by the flow of slurry into the basin from the supply and out of the basin through the drain, thereby inhibiting the suspended particles from settling; and conveying slurry from the basin to the semiconductor processing machine via a second pump.

11. The method of claim 10, wherein the delivery subsystem further includes a return conduit extending from the basin to the supply, the return conduit returning slurry flowed from the drain to the supply.

12. The method for supplying a slurry of a liquid containing suspended particles to a semiconductor processing machine, where the slurry is used in processing semiconductor wafers, the method comprising:

providing a supply of slurry;

conveying slurry from the supply to a delivery subsystem including a basin via a first pump, wherein the basin includes a top portion and a lip adjacent the top portion, the lip allowing overflow of the slurry from the basin, thereby inhibiting the settling of suspended particles in the slurry; and conveying slurry from the basin to the semiconductor processing machine via a second pump.

13. The method of claim 12, wherein the basin includes a generally funnel-shaped bottom portion, and a wall extending around the generally funnel-shaped bottom portion, wherein the lip is situated on the wall.

14. The method for supplying a slurry of a liquid containing suspended particles to a semiconductor processing machine, where the slurry is used in processing semiconductor wafers, the method comprising:

providing a supply of slurry;

conveying slurry from the supply to a delivery subsystem including a basin via a first pump, wherein the basin includes a top portion and an overflow gate oriented in the top portion, the overflow gate channeling slurry out of the basin, thereby inhibiting the settling of suspended particles in the slurry; and conveying slurry from the basin to the semiconductor processing machine via a second pump.

15. The method for supplying a slurry of a liquid containing suspended particles to a semiconductor processing machine, where the slurry is used in processing semiconductor wafers, the method comprising:

providing a supply of slurry;

conveying slurry from the supply to a delivery subsystem including a basin via a first pump, wherein the basin includes a container which receives slurry, a drain in the container, the drain allowing slurry to flow from the container, wherein the slurry in the container is agitated by the flow of slurry into the container and out of the container through the drain, and an enclosure surrounding the container, wherein the enclosure collects slurry flowed through the drain of the container; and conveying slurry from the basin to the semiconductor processing machine via a second pump.

16. The method of claim 15, wherein the enclosure includes a catch portion which collects slurry draining from the container.

17. The method of claim 16, wherein the delivery subsystem includes a return conduit extending from the catch portion to the supply.

18. The method of claim 15, wherein the container includes a top portion and a lip adjacent the top portion, the lip allowing overflow of the slurry from the container, thereby inhibiting the settling of suspended particles in the slurry.

19. The method of claim 18, wherein the enclosure includes a catch portion which collects slurry overflowing from the container.

20. The method of claim 15, wherein the enclosure further includes an air duct extending through the enclosure.

21. A method for supplying a slurry of liquid containing suspended particles to a semiconductor processing machine, where the slurry is used in processing semiconductor wafers, the method comprising:

providing a supply of slurry;

conveying slurry from the supply to a basin;

draining a portion of the slurry from the basin through a drain and mixing the portion of the slurry drained from the basin with other slurry prior to returning the slurry to the basin; and conveying a portion of the slurry from the basin to the semiconductor processing machine;

wherein the slurry in the basin is agitated by conveying and draining slurry, thereby inhibiting the settling of suspended particles in the slurry.

22. The method for supplying a slurry of liquid containing suspended particles to a semiconductor processing machine, where the slurry is used in processing semiconductor wafers, the method comprising:

providing a supply of slurry;

conveying slurry from the supply to a basin;

draining a portion of the slurry from the basin through a drain;

overflowing the slurry in the basin; and conveying a portion of the slurry from the basin to the semiconductor processing machine, wherein the slurry in the basin is agitated by conveying, draining, and overflowing, thereby inhibiting the settling of suspended particles in the slurry.

* * * * *